US010563449B2

(12) United States Patent
McKenna

(10) Patent No.: US 10,563,449 B2
(45) Date of Patent: Feb. 18, 2020

(54) MONOLITHIC THERMAL BREAK STRUCTURAL MEMBER

(71) Applicant: Arconic Inc., Pittsburgh, PA (US)

(72) Inventor: Gregory Blake McKenna, Cumming, GA (US)

(73) Assignee: Arconic Inc., Pittsburgh, PA (US)

( * ) Notice: Subject to any disclaimer, the term of this patent is extended or adjusted under 35 U.S.C. 154(b) by 0 days.

(21) Appl. No.: 15/906,080

(22) Filed: Feb. 27, 2018

(65) Prior Publication Data

US 2019/0264491 A1 Aug. 29, 2019

(51) Int. Cl.
*E06B 3/26* (2006.01)
*E06B 3/263* (2006.01)

(52) U.S. Cl.
CPC ..... *E06B 3/26301* (2013.01); *E06B 3/26* (2013.01); *E06B 3/26305* (2013.01); *E06B 2003/2637* (2013.01); *E06B 2003/26352* (2013.01); *E06B 2003/26379* (2013.01); *E06B 2003/26389* (2013.01)

(58) Field of Classification Search
CPC .... E06B 3/26301; E06B 3/26; E06B 3/26305; E06B 2003/26352; E06B 2003/26379; E06B 2003/26389; E06B 2003/2637; E06B 1/32; E06B 1/40; E06B 3/26309; E06B 3/26312; E06B 3/549
See application file for complete search history.

(56) References Cited

U.S. PATENT DOCUMENTS 4,115,972 A * 9/1978 Varlonga ..... E06B 3/26307 49/504
5,481,839 A * 1/1996 Lang ..... E04B 2/967 52/235
9,212,482 B2 * 12/2015 Frederick ..... E04B 2/965

FOREIGN PATENT DOCUMENTS

EP 1596022 A2 11/2005
EP 2657422 B1 4/2015

OTHER PUBLICATIONS

ISRWO for PCT/2019/0195521 which claims benefit of U.S. Appl. No. 15/906,080 dated Jun. 12, 2019.

* cited by examiner

*Primary Examiner* — Patrick J Maestri
(74) *Attorney, Agent, or Firm* — Vorys, Sater, Seymour and Pease LLP

(57) ABSTRACT

Provided herein are thermal break structural members for use in fenestration assembly products. In some embodiments, the thermal break structural member is monolithic with an infill retainer, being designed to bear a structural load while maintaining the overall integrity and thermal performance of the conjoint fenestration unit.

18 Claims, 6 Drawing Sheets

MONOLITHIC THERMAL BREAK STRUCTURAL MEMBER

TECHNICAL FIELD

The invention disclosed herein relates generally to a fenestration assembly and more specifically to achieving low thermal conductance across a fenestration assembly.

BACKGROUND OF THE INVENTION

Curtain walls, building facades, store fronts, windows, glazed doors, decorative and utility glazing and the like, generally known as fenestration products, are typically made with aluminum framework. Aluminum is favored because of its light weight combined with good strength and extrudability. The fenestration art has struggled, however, with the relatively high thermal conductivity of aluminum, which tends to reduce thermal efficiency in all climates.

One widely accepted solution to the thermal conductivity problem has been to introduce one or more members having low thermal conductivity between internal and external aluminum parts; often the inserted member is made of a synthetic polymer having a low thermal conductance. For example, glass fiber reinforced polymers of various kinds have been extruded to form such inserts. The industry uses the term "thermal break" to mean a piece of material having a low thermal conductivity that is inserted between high conductivity members in order to reduce heat transfer from one side of a structure to another. One recognized standard is that the thermal break material conductivity should not be more than 0.52 W/mK (3.60 Btu·in/h·ft$^2$–° F.); however, usage of the term "thermal break" herein is not intended to be limited to this standard, nor is it necessarily a piece inserted between others—in this context it may be attached to only a single member with high thermal conductivity.

The most energy efficient and ideal design would be one where thermal conductivity from the exterior to interior (or interior to exterior) of a building is zero. While this has not yet been achieved, there is an ever-present demand for improved thermal performance. One solution to decreasing thermal conductivity via a thermal break is increasing the size or length of the thermal break. However, as thermal breaks typically are not manufactured with the strength required to bear the load that other fenestration elements bear; therefore, enlarging the thermal break member may decrease the overall structural integrity of the fenestration assembly of which it is part.

Other components of the fenestration—doors, windows, and infill, such as glazing—bear a weight load of the fenestration assembly. The components also are subjected to other stressors, such as wind ("wind load"), which can impart notable torque and pressure changes on the glazing and other parts of the fenestration assembly. Infill must not merely be held in place, but must be able to withstand wind load. To assist in securing infill, various styles of retainers, sometimes known as pressure plates, have been developed to assure the integrity of the installation.

Each element of a conjoint fenestration unit, particularly those on the external side, is subjected to weather, including changes in temperature. Thus, consideration must also be taken in choosing suitable materials for conjoining elements at their intersection. As noted above, strength and thermal conductivity may be considered, but thermal expansion also contributes to the overall integrity of the conjoint fenestration unit. When conjoining different materials, their different thermal expansion properties will cause the conjoining elements to expand differently thus changing the strength of the connection between said conjoining elements.

Finally, thermal breaks are typically manufactured separately from other fenestration products and thus must be fastened to the other parts during assembly, for example, with clips or other fastening mechanisms. Pressure plates (and other retainers), thermal breaks and all other required parts (e.g., gaskets, clips) form a list of parts cumbersome to inventory and assemble. Generally, the more parts there are to install, the more labor is required, and the possibility of faulty assembly is increased.

Thus, driven by the need for both simplified assembly and increased thermal performance, the present invention aims to reduce the number of parts in the fenestration assembly, to maintain or improve the ability to withstand wind load and other stresses, and to maintain or improve thermal performance, thereby reducing both manufacturing and installation costs.

SUMMARY OF THE INVENTION

Various embodiments provide a fenestration assembly achieving low thermal conductance through the use of a monolithic thermal break structural member with enhanced thermal and structural properties. In one aspect, the present invention provides a conjoint fenestration unit, said fenestration unit having (a) a first member and (b) a monolithic thermal break structural member. In one embodiment, said fenestration unit may have a conjoint extended profile configured to connect the first member and the monolithic thermal break structural member. In a further embodiment, the first member may be made of a thermally-conductive strong material, for example, aluminum. In further embodiments of any aforementioned embodiment, said first member may be manufactured by extrusion.

In a further embodiment, the monolithic thermal break structural member may have a profile that includes at least one finger that may be conjoined to at least one recess on an opposing first member. In another embodiment of any of the forgoing embodiments, this connection may be further strengthen by crimping claws on the first member around the at least one finger on the monolithic thermal break structural member to the at least one recess on the opposing first member. Further, in another embodiment of any of the foregoing embodiments, this connection may be further strengthened by the use of adhesives between the conjoining members.

The conjoint fenestration unit may have an internal and external portion. In some embodiments, the first member occupies the internal portion and the monolithic thermal break structural member occupies the external portion. In an alternative embodiment, the first member occupies the external portion and the monolithic thermal break structural member occupies the internal position.

In a further embodiment of any aforementioned embodiments, the profile of the monolithic thermal break structural member may have a hollow area.

In another embodiment, the present invention provides the conjoint fenestration unit as described in any foregoing embodiment, but further including infill. In some embodiments, the infill is secured in the space created by conjoining the at least one finger on said monolithic thermal break structural member to the at least one recess on said first member. In another embodiment of any foregoing embodiments, the monolithic thermal break structural member may be on the external side of the conjoint fenestration unit and serves both as a thermal break and also structurally to fasten and secure the infill in place against the internal portions of the conjoint fenestration assembly. In another embodiment of any foregoing embodiments, one or more gaskets or glazing seals may be positioned between said monolithic thermal break structural member and the secured infill. In any one of the above embodiments, the infill may be glazing. In other alternative embodiments, the infill is another material.

The profile of any of the foregoing embodiments of a monolithic thermal break structural includes a panel and a stem, wherein the panel has a center portion from which the stem projects and wherein the stem includes a terminus contoured for conjoining with a complementary portion of a fenestration product. In some embodiments, the stem projects from the panel at a place other than the midpoint. In another embodiment of any foregoing embodiment, the stem has a terminus having a shoulder on each side of the terminus and at least one finger between said shoulders.

In another embodiment of any forgoing embodiments, the panel may also have two end portions, each contoured for interconnection inwardly with a gasket or a seal. In particularly useful embodiments, the gasket or seal maybe used to secure infill as describe in the paragraph immediately preceding this one.

In any of the foregoing embodiments, the monolithic thermal break structural member may be manufactured from a material with low thermal conductivity. For example, in some embodiments, the material is a fiber reinforced polymer. In further embodiments, fiberglass-reinforced urethane is used.

In any of the foregoing embodiments, the monolithic thermal break structural member may be manufactured by extrusion or pultrusion.

BRIEF DESCRIPTION OF THE DRAWINGS

Aspects, features, benefits, and advantages of the embodiments herein will be apparent with regard to the following description, appended claims, and accompanying drawings. In the following figures, like numerals represent like features in the various views. It is to be noted that features and components in these drawings, illustrating the views of embodiments of the presently disclosed invention, unless stated to be otherwise, are not necessarily drawn to scale.

DETAILED DESCRIPTION OF THE INVENTION

In the following description, the present invention is set forth in the context of various alternative embodiments and implementations involving a monolithic thermal break structural member and its use in fenestration products. While the following description discloses numerous exemplary embodiments, the scope of the present patent application is not limited to the disclosed embodiments, but also encompasses combinations of the disclosed embodiments, as well as modifications to the disclosed embodiments as well as other embodiments.

Within the context of the present invention and as discussed in the background section, thermal break is used to mean a mean a piece of material having a low thermal conductivity that is attached to a member of high conductivity in order to reduce heat transfer.

In one aspect, the present invention provides a monolithic thermal break structural member. Within the context of the invention, the monolithic thermal break structural member may be used a conjoint fenestration unit to reduce the thermal conductivity across materials and improve thermal performance. In some embodiments, the monolithic thermal break structural members are used to secure infill, for example, glazing, within a fenestration assembly and may be considered part of the fenestration unit utilized to achieve that goal. In some embodiments, the monolithic thermal break structural member may assume some or all of the load supported by an infill retainer, for example, a pressure plate. In such embodiments, a separate retainer or pressure plate may not be required, reducing the number of parts required for assembly and simplifying the assembly process. Examples of suitable fenestration assemblies include, but are not limited to, doors, storefronts, and fixed windows.

Figure 1:
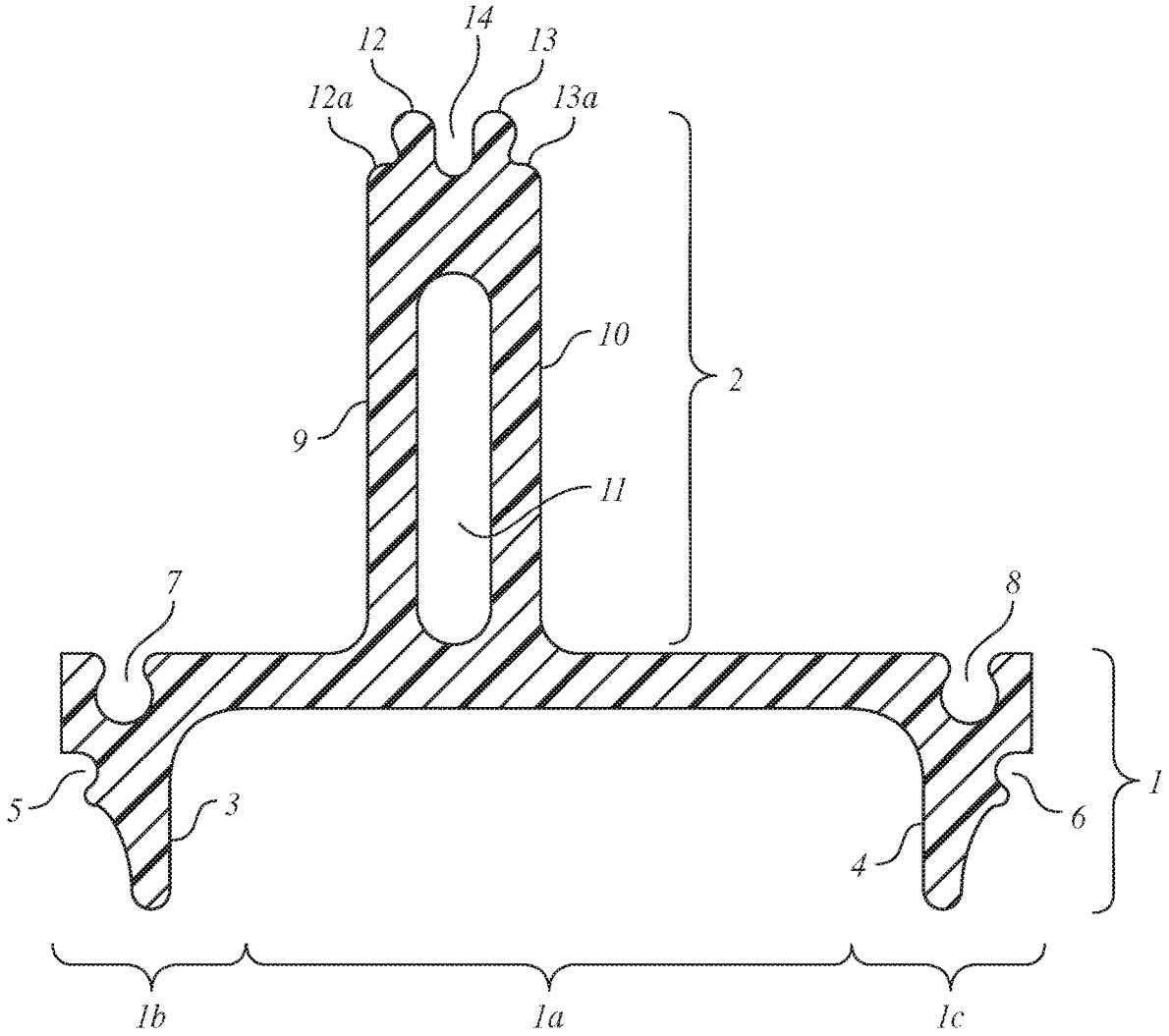
FIG. 1 illustrates one embodiment of a monolithic thermal break structural member as disclosed and described herein.

FIG. 1 shows one embodiment of a monolithic thermal break structural member that may be used in a conjoint fenestration unit as viewed from above. The monolithic thermal break structural member shown in FIG. 1 has a profile with a panel 1 and a stem 2, connecting to form a general T-shaped section with the stem of the T somewhat offset from center. The monolithic thermal break structural member is oriented in FIG. 1 so the exterior of the building or fenestration installation is at the bottom of the view; thus the view is from overhead as the piece is to be installed. Panel 1 has a center portion 1*a* and end portions 1*b* and 1*c*. Legs 3 and 4 extend outwardly from end portions 1*b* and 1*c*. Niches 5 and 6 on end portions 1*b* and 1*c* are designed to receive complementary flanges of aluminum or other façade components in a secure relationship. Gasket recesses 7 and 8 on end portions 1*b* and 1*c* are contoured to receive complementary flanges on gaskets (not shown) to be placed between panel 1 and the glazing. Stem 2 is integral and monolithic to panel 1 and has two walls 9 and 10 enclosing an optional air-filled area 11. At the terminus of stem 2 are two fingers 12 and 13, defining a recess 14 between them. Fingers 12 and 13 and recess 14 are contoured to receive a complementary fastening flange (not shown) and to complement recesses on an attached structural part (also not shown). The terminus of stem 2 also includes shoulders 12*a* and 13*a* next to fingers 12 and 13. Shoulders 12*a* and 13*a* are contoured to accept the crimping claws of an attached structural part. Stem 2 may be offset or centered (not shown). In some embodiments, such as shown in FIG. 1, stem 2 is offset in center portion 1*a* to facilitate the assembly of the glazing parts of the final structure.

Figure 2:
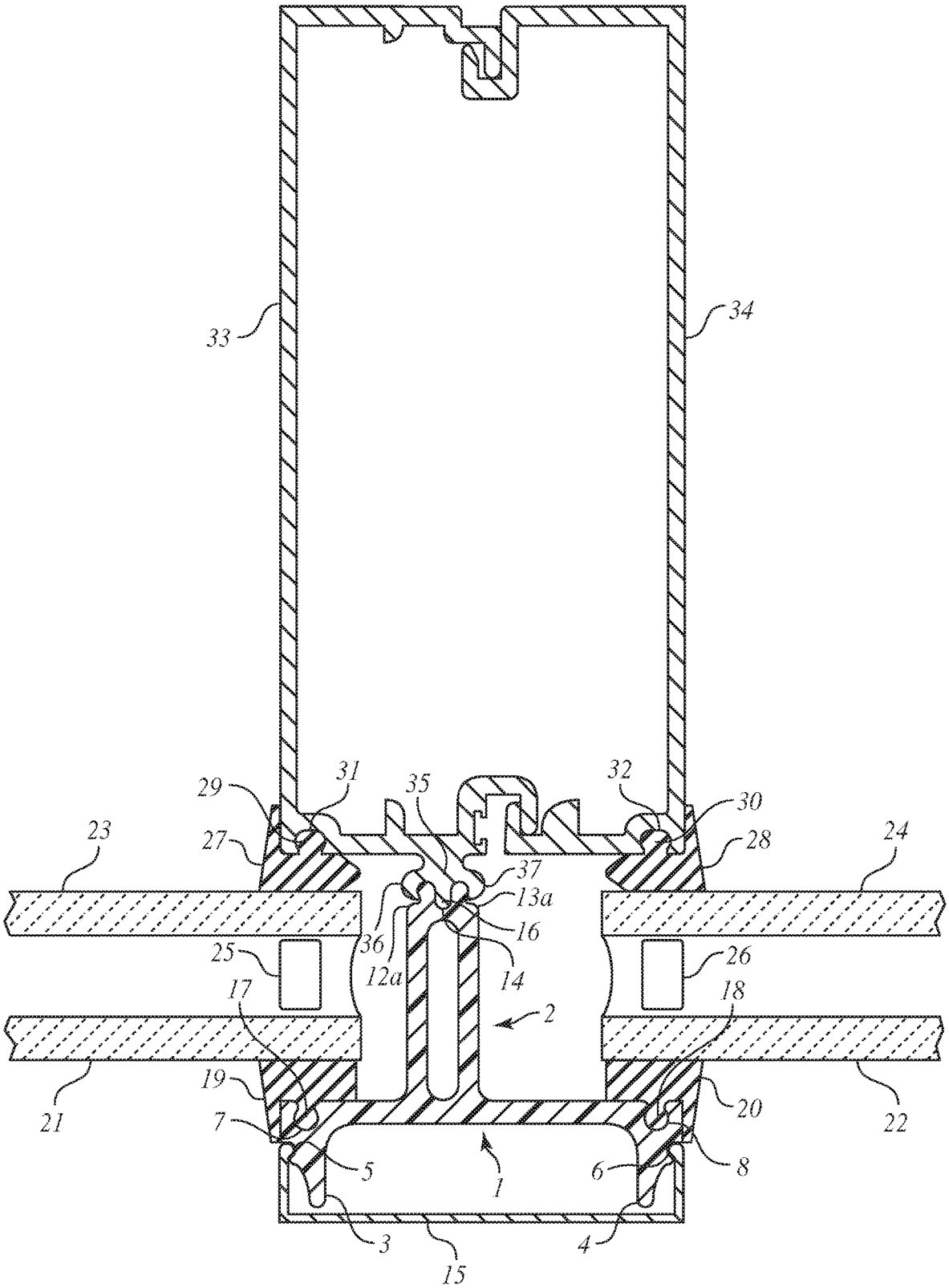
FIG. 2 shows the embodiment of FIG. 1 installed in a portion of a curtain wall.

In FIG. 2, a section of a curtain wall is shown in which the embodiment of the monolithic thermal break structural member in a specified length of an extrusion or pultrusion having the profile as depicted in FIG. 1 has been installed. FIG. 2 is a cross section of the invention in a curtain wall as viewed from above, wherein the exterior of the installation is at the bottom. A cover 15, which may be decorative, has been placed on the exterior of panel 1, fitted into niches 5 and 6 near the tops of legs 3 and 4. Gasket recesses 7 and 8 receive flanges 17 and 18 of gaskets 19 and 20. Infill sheets 21 and 22 (usually glass) contact gaskets 19 and 20. Infill sheets 21 and 22 are separated from infill sheets 23 and 24 by spacers 25 and 26. The infill sheets 23 and 24 are lined by gaskets 27 and 28, which have flanges 29 and 30 for insertion into recesses 31 and 32 of first member 33 and 34. As used herein, "first member" generally refer to any member to which the monolithic thermal break is attached that is made from thermally conductive material, for example, aluminum, titanium, steel, and mixture thereof. While the disclosure describes this member as extruded aluminum, it is contemplated herein to employ metals other than aluminum and methods of manufacturing said member other than extrusion without departing from the scope of the disclosure. Stem 2 may be dimensioned to dictate the distance from panel 1 through the position of glazing sheets 23 and 24. Generally, the longer the distance from panel 1 through the position of the glazing sheets 23 and 24 may increase the volume of low conductance material and increase thermal efficiency. However, lengthening stem 2 also may affect the design of the internal structure represented by aluminum extrusions 33 and 34, and may decrease structural performance. Shortening the distance and reducing the volume of conductance material may decrease thermal performance. Thus, the length of stem 2 may be varied to achieve a suitable balance between structural performance and thermal performance. Aluminum extrusion 33 includes an arm 35 having a central flange 16 which mates with a recess 14 and fingers 12 and 13 (see FIG. 1) of stem 2; arm 35 includes claws 36 and 37 which may be crimped over fingers 12 and 13. In some embodiments, fingers 12 and 13 (see FIG. 1 also) are designed to snap over a central flange 16 on a conjoining member inserted into recess 14 in order to temporarily hold the assembly together until the interconnection is crimped. In FIG. 2, claws 36 and 37 extend substantially to and rest upon shoulders 12*a* and 13*a*. The claws may be crimped towards fingers 12 and 13 after conjoining with stem 2 to secure the connection. Crimping may be accomplished in any suitable manner such as by using rollers to deform the aluminum. An adhesive (not shown) may coat the surfaces of any or all interconnected parts to further strengthen the connection. For example, in some embodiments, adhesive such as epoxy or other adhesive is applied to arm 35 on the surface where it contacts recess 14 of stem 2. Aluminum extrusions 33 and 34 may be of any design suitable for the interior portion of the installation and one of skill in the art will be familiar with and readily identify a number of extrusion designs that can be used. By employing any one of the monolithic thermal break structural members with the extended profiles as described and contemplated herein, a firm connection between the interior and the exterior may be made and glazing may be secured in place with greatly improved thermal efficiency compared to previous combinations. In short, the monolithic thermal break structure member may serve a role of both reducing thermal conductivity and as an infill retainer.

Figure 3:
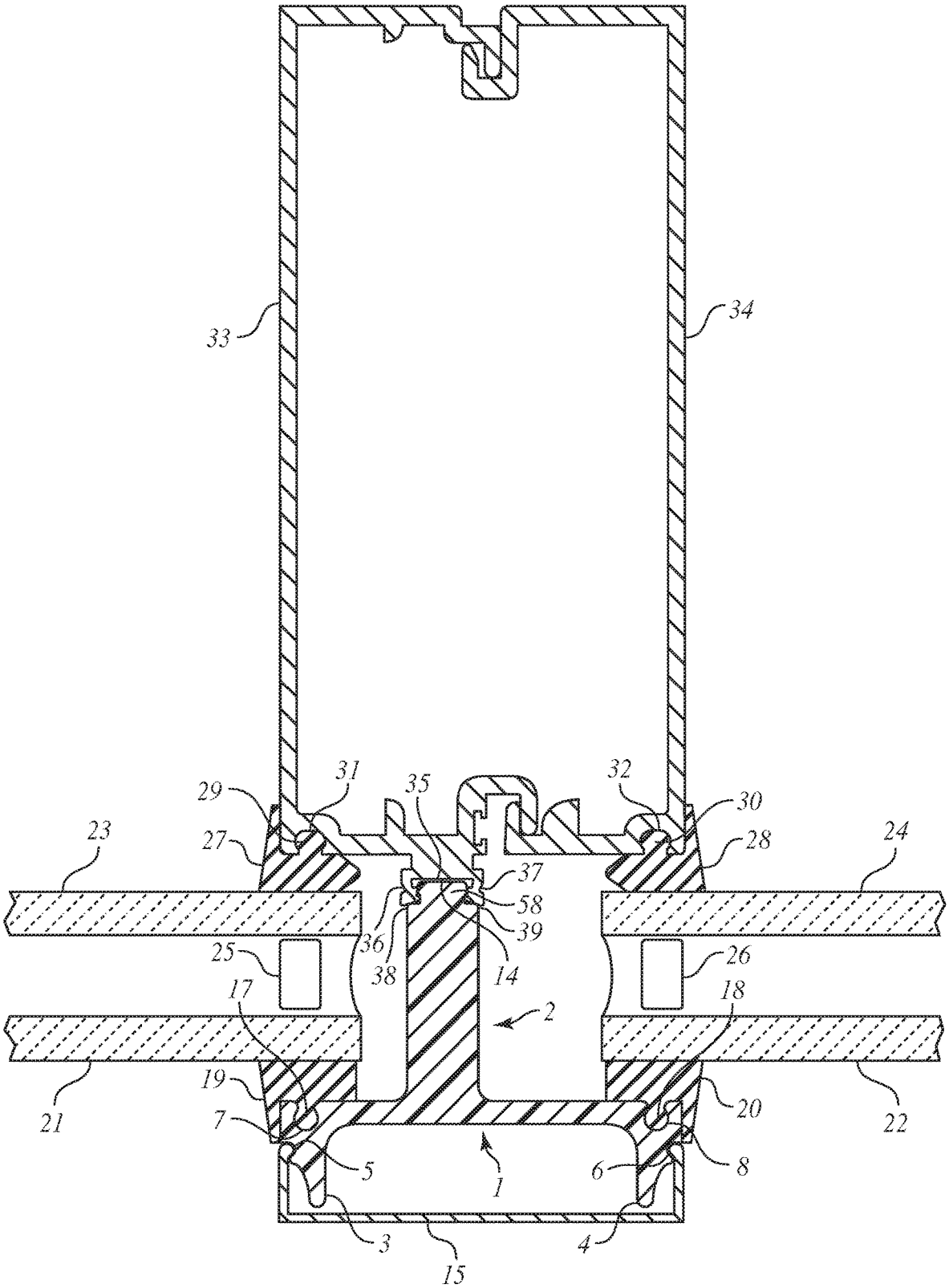
FIG. 3 illustrates another embodiment of a monolithic thermal break structural member as disclosed herein installed in a portion of a curtain wall.

FIG. 3 illustrates another embodiment of a monolithic thermal break structural member installed in a section of a curtain wall. In FIG. 3, stem 2 has a single finger 58 that mates with a recess on arm 35 on aluminum extrusion 33. As in FIG. 2, claws 36 and 37 on arm 35 are crimped to form a firm connection with stem 2, and rest on shoulders 38 and 39. In contrast to the embodiments of the monolithic thermal break structural member shown in FIG. 1 and FIG. 2, there is no air-filled area 11 in the embodiment of the monolithic thermal break structural member shown in FIG. 3. Additionally, the embodiment shown in FIG. 3, similar to that shown in FIG. 2, provides a monolithic thermal break structural member that also function as an infill retainer.

Figure 4:
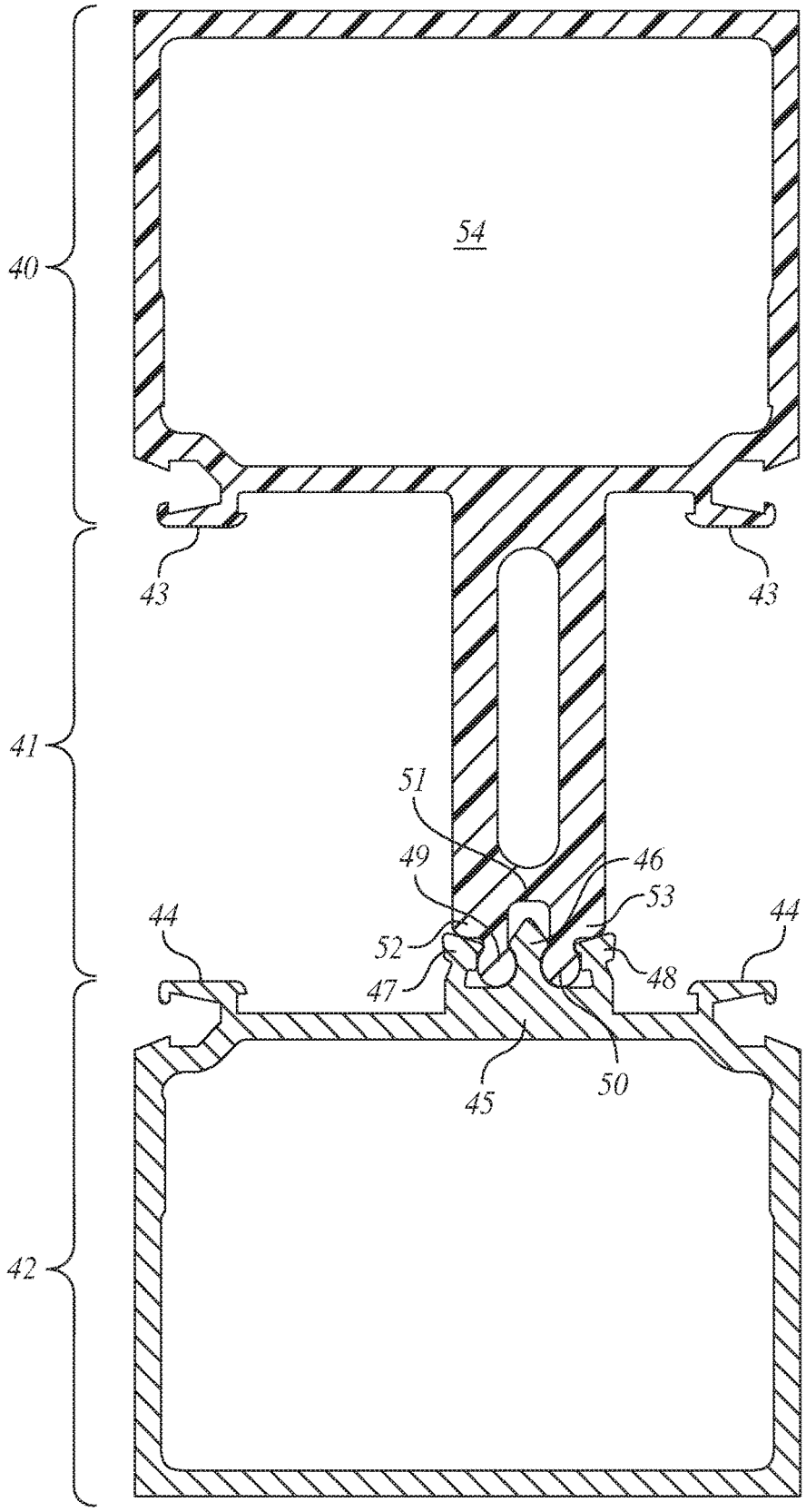
FIG. 4 illustrates yet another embodiment of a monolithic thermal break structural member as disclosed herein in a conjoint assembly an arrangement of the invention as part of a storefront.

FIG. 4 shows a conjoint glazing unit illustrating yet another embodiment of a monolithic thermal break structural member. The monolithic thermal break structural member as depicted in FIG. 4 has a panel 40 and a stem 41. Unlike panel 1 as depicted in each of FIGS. 1, 2, and 3, panel 40 has a hollow area 54. In FIG. 4, the depicted thermal break monolith is connected to an aluminum extrusion 42. Arm 45 of aluminum extrusion 42 has a central flange 46 and claws 47 and 48. Fingers 49 and 50 on the terminus of stem 41 are separated by a recess 51 for receiving the central flange 46 of the aluminum extrusion. Stem 41 also has shoulders 52 and 53 which may be contacted by or support claws 47 and 48. After they are conjoined with fingers 49 and 50, claws 47 and 48 may be crimped around said fingers.

An adhesive (not shown) may be applied to one or more of the surfaces of one or more interconnected parts to further strengthen the connection. For example, in some embodiments, an adhesive may be applied to the surfaces between arm 45 and stem 41 prior to attaching. Within the context of this embodiment, the fingers, flanges, and claws of arm 45 and stem 41 may have an extended profile configured to conjoin or snap together and have substantial contact between complementary surfaces throughout much of their length.

Stem 41 may be dimensioned to accommodate other assembly parts, including glazing, gaskets, spacers, and infill retainers, in the final assembly while adequately securing glazing between opposing retention surfaces 43 and 44. In some embodiments, a conjoint glazing unit, such as the one depicted in FIG. 4, may be useful as part of a storefront, wherein aluminum extrusion 42 is intended to be positioned on the exterior of the storefront and panel 40 on the interior. By employing a monolithic thermal break structural member in a conjoint assembly, such as shown in FIG. 4, the conjoint assembly may be both strong and thermally efficient. Notably, the conjoint assembly depicted in FIG. 4 contains only two assembly parts, thus also potentially greatly reducing the number of parts required for assembly, simplifying keeping inventory and the assembly process. Further, fewer parts also reduces the chance for error during assembly.

Figure 5:
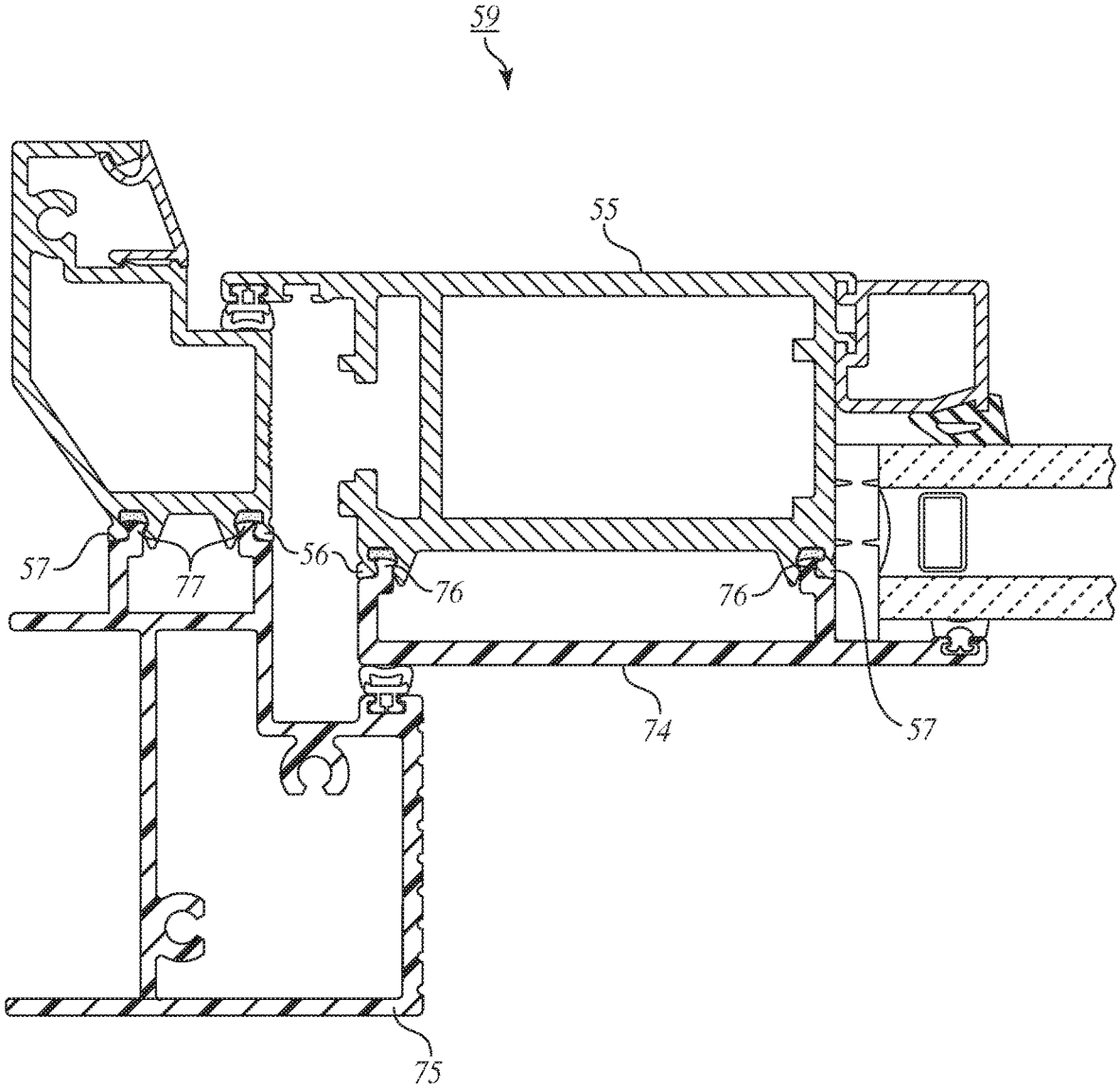
FIG. 5 shows a thermal break structural member installed in a door.

In FIG. 5 a section of a door 59 is shown utilizing two monolithic thermal break structural members 74 and 75. 55 is an extruded aluminum member. Claws 56 and 57 may be crimped over fingers 76 and 77 on each of the thermal break structural members 74 and 75 to attach the extruded aluminum member 55 to each monolithic thermal break structural member 74 and 75.

Figure 6:
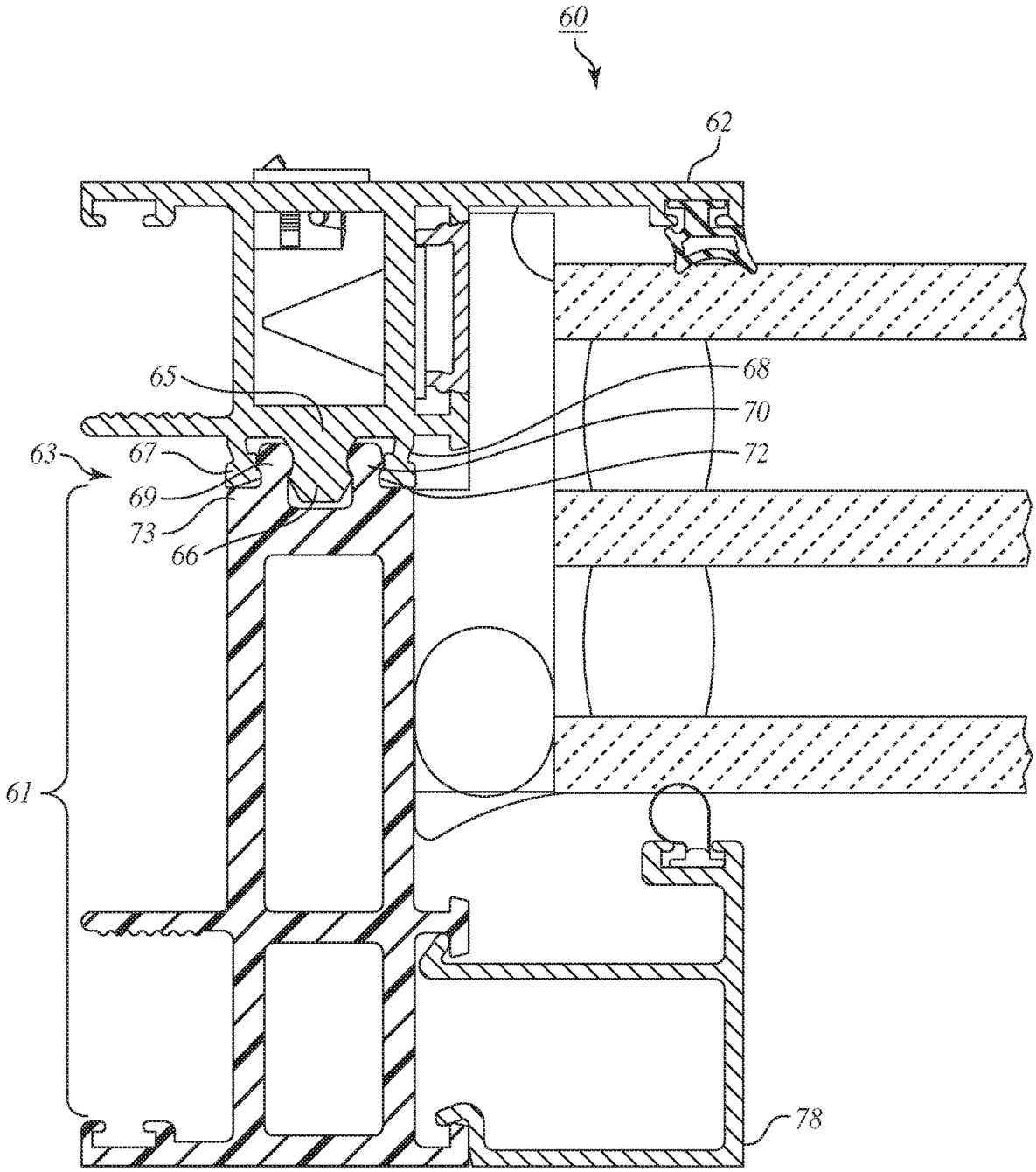
FIG. 6 shows another embodiment of a monolithic thermal break structural member as disclosed herein as part of a fixed window.

FIG. 6 shows another embodiment of a monolithic thermal break structural member of the present invention as used in a fixed window 60. In FIG. 6, an extruded aluminum member 62 attaches to second aluminum member 78 though a monolithic thermal break structural member 63. The monolithic thermal break structural member 63 has stem 61. The terminus of stem 61 has two fingers 69 and 70 that will conjoin with the central flange 66 and claws 67 and 68 on the aluminum extrusion 62. Stem 61 also has shoulders 72 and 73 which may be contacted by claws 67 and 68. An adhesive (not shown) may be applied to one or more of the surfaces of one or more interconnected parts to further strengthen the connection. Within the context of this embodiment, the fingers, flanges, and claws of arm 65 and stem 61 have an extended profile to enable them to conjoin or snap together and have substantial contact between complementary surfaces throughout much of their length. After they are conjoined, claws 67 and 68 may be crimped to strengthen the connection. By employing a monolithic thermal break structural member in a conjoint assembly, such as shown in FIG. 6, the conjoint assembly may be both strong and thermally efficient.

Within the context of the present invention, the monolithic thermal break structural members may be made of any material that has low thermal conductivity, for example, fiberglass, glass-reinforced polyamide or epoxy based carbon fiber. In some embodiments they may be made from fiber-reinforced polymer, for example, fiberglass-reinforced polymer. The monolithic thermal break structural member may be prepared by extrusion or pultrusion. One of skill in the art would be familiar with and skilled at both extrusion and pultrusion methods and be able to easily apply said methods to manufacture a suitable monolithic thermal break structural member without undue experimentation.

The extruded or pultruded monolithic thermal break structural member may be manufactured in a variety of lengths and cut to any desired length. For example, in some embodiments, monolithic thermal break structural members are manufactured at length of 24 feet and cut in half to use 12 foot long monolithic thermal break structural members in the fenestration assembling process.

By utilizing a monolith thermal break structural member as described by any one of the numerous embodiments herein, advantages over prior fenestration assembly designs may be achieved. For example, by utilizing a stronger material, e.g., a fiber-reinforced polymer, that, at the same time, has low thermal conductance, a single fenestration element may be used that satisfies the role of both a thermal break and an infill retainer, greatly reducing the number of parts in the conjoint fenestration unit assembly. The strength of the connection between the monolithic thermal break structural member and the rest of the fenestration assembly is imparted due to the profile at that location. In particular, the one or more fingers on the monolithic thermal break structural member that may be may be conjoined with the one or more recesses in the opposing member (e.g., an extruded aluminum member) and then crimped provides a secure connection. Adhesive may further strengthen this connection. The profile and geometry at this connection further allows consideration of other materials to be used to construct the monolithic thermal break structural members, even those that may have mismatched thermal expansion properties when compared to the material of the opposing piece (e.g. aluminum).

Embodiments disclosed herein include:

A. A conjoint fenestration unit including a first member and a monolithic thermal break structural member, said fenestration unit having a conjoint extended profile configured to connect the first member and the monolithic thermal break structural member.

B. A monolithic thermal break structural member having a profile that includes a panel and a stem, wherein the panel has a center portion from which the stem projects and wherein the stem includes a terminus contoured for conjoining with a complementary portion of a fenestration product.

Each of embodiments A and B may have one or more of the following additional elements in any combination: Element 1: wherein the monolithic thermal break structural member is extruded or pultruded. Element 2: wherein said conjoint extended profile comprises at least one finger on said monolithic thermal break structural member conjoined to at least one recess on said first member. Element 3: wherein claws on the first member are crimped around the at least one finger on said monolithic thermal break structural member conjoining to the at least one recess on the first member. Element 4: further comprising an adhesive between the at least one finger on the said monolithic thermal break structural member and the at least one recess on the first member. Element 5: wherein the monolithic thermal break structural member comprises a fiber-reinforced polymer. Element 6: wherein the fiber-reinforced polymer is fiberglass-reinforced urethane. Element 7: wherein the first member is extruded aluminum. Element 8: further comprising a hollow area in the monolithic thermal break structural member. Element 9: further comprising infill in a space created by conjoining the at least one finger on said monolithic thermal break structural member to the at least one recess on said first member. Element 10: wherein one or more gaskets or seals are positioned between said monolithic thermal break structural member and the secured infill. Element 11: wherein the infill is glazing. Element 12: the monolithic thermal break structural member is the only pressure plate. Element 13: wherein the panel has two end portions, each contoured for interconnection inwardly with a gasket or a seal. Element 14: further comprising a material with low thermal conductivity. Element 15: wherein the material is a fiber-reinforced polymer. Element 16: wherein the fiber-reinforced polymer is fiberglass-reinforced urethane. Element 17: wherein the stem projects from the panel at a point other than the midpoint of the panel. Element 18: wherein the terminus of the stem comprises a shoulder on each side of said terminus and at least one finger between said shoulders.

By way of non-limiting example, exemplary combinations applicable to A and B include: Element 2 with Element 3; Element 2 with Element 4; Element 5 with Element 6; Element 2 with Element 9; Element 9 with Element 10; Element 9 with Element 11; Element 9 with Element 12; Element 14 with Element 15; and Element 15 with Element 16. In addition, by way of non-limiting example combinations applicable to A and B include Elements 1 through 12 and any combination of Elements 1 thought 12; and Elements 13-18 and any combination of Elements 13-18.

The disclosed apparatus, systems, and methods disclosed herein are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The apparatus, systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e. each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Although various example embodiments have been disclosed, a worker of ordinary skill in this art would recognize that certain modifications would come within the scope of this disclosure. For that reason, the following claims should be studied to determine the scope and content of this disclosure.

What is claimed is:

1. A conjoint fenestration unit comprising:

a first member having first and second claws extending therefrom and a central flange disposed between the first and second claws;

a monolithic thermal break structural member providing a panel and a stem extending from the panel and configured to connect the first member to the monolithic thermal break structural member;

first and second fingers extending from the stem and separated by a recess, wherein the central flange is received in the recess of the stem and the first and second fingers are conjoined with the first and second claws; and at least one infill positioned in a space between the first member and the monolithic thermal break structural member, wherein the stem extends into the space to connect to the first member.

2. The conjoint fenestration unit of claim 1, wherein the monolithic thermal break structural member is extruded or pultruded.

3. The conjoint fenestration unit of claim 1, wherein at least one finger of the first and second fingers is conjoined to at least one recess on said first member.

4. The conjoint fenestration unit of claim 3, wherein claws on the first member are crimped over the first and second fingers.

5. The conjoint fenestration unit of claim 3, further comprising an adhesive between at least one finger of the first and second fingers on the monolithic thermal break structural member and the recess on the first member.

6. The conjoint fenestration unit of claim 1, wherein the monolithic thermal break structural member comprises a fiber-reinforced polymer.

7. The conjoint fenestration unit of claim 1, further comprising a hollow area in the monolithic thermal break structural member.

8. The conjoint fenestration unit of claim 1, wherein one or more gaskets or seals are positioned between the panel and the at least one infill.

9. The conjoint fenestration unit of claim 1, wherein the infill is glazing.

10. A monolithic thermal break structural member having a profile comprising a panel and a stem, wherein the panel has a center portion from which the stem projects and two end portions positioned at opposing ends of the center portion and each end portion having a leg extending outwardly therefrom;

wherein the stem includes a terminus having first and second fingers separated by a recess and extending from the terminus, the first and second fingers being contoured for conjoining with a complementary portion of a fenestration product, wherein the stem extends from the center portion and thereby creates a space to receive an infill between the panel and the fenestration product, wherein at least one of the end portions of the panel is configured to extend across a portion of the infill when the monolithic thermal break structural member, the fenestration product, and the infill are assembled, wherein the first and second fingers are separated by a recess and contoured to snap together with a first feature of the complementary portion of the fenestration product when the first feature is received in the recess, and wherein the first and second fingers are contoured to snap together with a second feature of the complementary portion of the fenestration product.

11. The monolithic thermal break structural member of claim 10, wherein an inwardly facing surface of each of the two end portions are each contoured for interconnection inwardly with a gasket or a seal.

12. The monolithic thermal break structural member of claim 10, further comprising a material with low thermal conductivity.

13. The monolithic thermal break structural member of claim 10, wherein the stem projects from the panel at a point other than the midpoint of the panel.

14. The monolithic thermal break structural member of claim 10, further comprising:

a shoulder provided on each side of the terminus of the stem wherein the first and second fingers extend from the terminus between the shoulder provided on each side of the terminus.

15. The monolithic thermal break structural member of claim 14, wherein at least one of the first and second fingers is contoured to be crimped within the complementary portion of the fenestration product.

16. The conjoint fenestration unit of claim 1, wherein the first and second claws snap together with the first and second fingers.

17. The conjoint fenestration unit of claim 1, wherein the first and second claws are crimped to the first and second fingers.

18. The conjoint fenestration unit of claim 1, wherein the panel extends across a portion of the at least one infill.

* * * * *